US008470193B1

(12) United States Patent
Browne et al.

(10) Patent No.: US 8,470,193 B1
(45) Date of Patent: Jun. 25, 2013

(54) MAGNETORHEOLOGICAL FLUIDS INCLUDING SHAPE MEMORY ALLOYS

(71) Applicant: GM Global Technology Operations LLC, Detroit, MI (US)

(72) Inventors: Alan L. Browne, Grosse Pointe, MI (US); Nancy L. Johnson, Northville, MI (US); Peter Maxwell Sarosi, Ferndale, MI (US); John C. Ulicny, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/686,847

(22) Filed: Nov. 27, 2012

Related U.S. Application Data

(60) Provisional application No. 61/576,147, filed on Dec. 15, 2011.

(51) Int. Cl.
*H01F 1/44* (2006.01)

(52) U.S. Cl.
USPC ..... 252/62.52; 252/62.55

(58) Field of Classification Search
USPC ..... 252/62.55, 62.52
See application file for complete search history.

(56) References Cited

U.S. PATENT DOCUMENTS 8,006,759 B1 8/2011 Cochran, Jr. et al.
2010/0224820 A1 9/2010 Ulicny et al.

FOREIGN PATENT DOCUMENTS

IN 200801008 I4 * 10/2009

OTHER PUBLICATIONS

Derwent abstract for IN 200801008 I$, Oct. 20, 2009.*

* cited by examiner

*Primary Examiner* — Carol M Koslow
(74) *Attorney, Agent, or Firm* — Dierker & Associates, P.C.

(57) ABSTRACT

Magnetorheological (MR) fluids are disclosed herein. An example of the MR fluid includes a carrier fluid, magnetic particles disposed in the carrier fluid, and non-magnetic particles disposed in the carrier fluid. The non-magnetic particles are particles of a shape memory alloy having an Austenite finish temperature ($A_f$) that is lower than a temperature encountered in an application in which the MR fluid is used so that the shape memory alloy exhibits stress-induced superelasticity.

17 Claims, 1 Drawing Sheet

MAGNETORHEOLOGICAL FLUIDS INCLUDING SHAPE MEMORY ALLOYS

CROSS-REFERENCE TO RELATED APPLICATIONS

This application claims the benefit of U.S. Provisional Application Ser. No. 61/576,147, filed Dec. 15, 2011.

TECHNICAL FIELD

The present disclosure relates generally to magnetorheological fluids including shape memory alloys.

BACKGROUND

Magnetorheological (MR) fluids are fluids having rheological properties that may be modified in response to an applied magnetic field. MR fluids are often used in control-based applications, such as, for example, dampers, shock absorbers, and clutches of an automobile.

SUMMARY

A magnetorheological fluid includes a carrier fluid, magnetic particles disposed in the carrier fluid, and non-magnetic particles disposed in the carrier fluid. The non-magnetic particles are particles of a shape memory alloy having an Austenite finish temperature ($A_f$) that is lower than a temperature encountered in an application in which the MR fluid is used so that the shape memory alloy exhibits stress-induced superelasticity.

BRIEF DESCRIPTION OF THE DRAWINGS

Features and advantages of examples of the present disclosure will become apparent by reference to the following detailed description and the drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
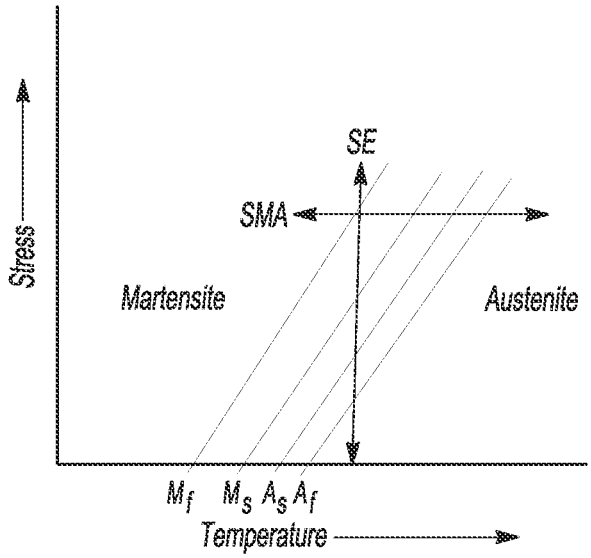
FIG. 1 is a stress and temperature based phase diagram for a shape memory alloy.

Example(s) of the magnetorheological (MR) fluid as disclosed herein may be used in various automotive mechatronic devices including, as examples, fan clutches, transmission clutches, power steering pumps, semi-active suspension systems, and tunable-response safety systems. It is envisioned that the MR fluid may also be useful for other technologies not related to the automotive industry, examples of which include body armor, energy absorption technologies, and optics, e.g., in the defense, construction, aerospace, and medical industries.

As used herein, a "magnetorheological fluid" or "MR fluid" refers to a suspension of at least magnetizable particles in a carrier medium, where the suspension has rheological properties that may be modified by an applied magnetic field. The rheological properties include those that are responsible for the flow of the MR fluid, such as, e.g., its viscosity and yield strength. For instance, when a magnetic field is applied to the fluid, magnetic particles of the MR fluid may align in a direction parallel to the magnetic field. The magnetic particles may also align perpendicular to the direction of the flow of the MR fluid, and impede the flow of the MR fluid. When this occurs, the MR fluid may behave more as a solid than as a liquid.

Example(s) of the MR fluid disclosed herein include the magnetic particles disposed in a carrier fluid, and further include non-magnetic particles that are also disposed in the carrier fluid. The non-magnetic particles are particles of a shape memory alloy (SMA) that exhibit stress-induced superelasticity (discussed further below). For purposes of the instant disclosure, the shape memory alloy making up the non-magnetic particles of the MR fluid is referred to herein as a superelastic shape memory alloy (or superelastic SMA). SMAs generally exhibit shape memory characteristics, i.e., they have the ability to recover their original geometry after deformation when subjected to an appropriate stimulus. It is believed that use of the superelastic shape memory alloy in the MR fluid will, in examples where the superelastic SMA particles have a hollow geometric form, reduce the overall mass of the MR fluid. It is further believed that the use of superelastic SMAs in the MR fluid may further increase suspension stability (i.e., reduce settling of the magnetic particles in the carrier fluid without having to use an anti-settling agent in the fluid) and enhance magnetic yield stress. It is even further believed that the enhancement of the magnetic yield stress also leads to more powerful and potentially smaller MR devices (e.g., MR devices that are lighter in weight). The mechanism for the enhanced magnetic yield stress may be due to inter-particle friction, particle packing effects, an inverse ferrofluid-type effect, or a combination of two or more of these mechanisms.

The carrier medium for the MR fluid may be chosen from any suitable carrier medium, some examples of which include water, mineral oils, synthetic oils, hydrocarbons, silicone oils, elastomers, fats, gels, greases, esters, polyethers, fluorinated polyethers, polyglycols, fluorinated hydrocarbons, halogenated hydrocarbons, fluorinated silicones, organically modified silicones, copolymers thereof, and combinations thereof. One specific example of the carrier fluid is a polyalphaolefin, which is a synthetic oil. This carrier fluid may have a kinematic viscosity ranging from about 1.65 cSt to 1.70 cSt at 100° C., and an acid number of less than or equal to about 0.05 mgKOH/g.

In an example, the carrier fluid makes up about 40 vol % to about 90 vol % of the MR fluid. In another example, the carrier fluid makes up from about 55 vol % to about 90 vol % of the MR fluid.

The magnetic particles may be added to the carrier fluid, or the carrier fluid may be added to the magnetic particles. In an example, the magnetic particles are homogenously dispersed in the carrier fluid. It is to be understood that, by homogeneously dispersed, the magnetic particles may be homogeneously dispersed or substantially homogeneously dispersed (e.g., within about a 5% of being completely homogeneously dispersed). Homogeneity may be determined by the human eye.

The magnetic particles may be chosen from particles of any magnetic material, some examples of which include a metal, a metal alloy, a magnetic oxide ceramic, a mixed ferrite, and combinations thereof. Some specific examples of metal particles include those of iron (e.g., carbonyl iron), cobalt, nickel, and alloys of these metals. Specific examples of alloys of these metals include iron-cobalt particles, iron-nickel particles, magnetic steel particles, and iron-silicon particles. Examples of magnetic oxide ceramic particles include cubic ferrites or mixed ferrites, perovskites, and garnets having one or more metals chosen from iron, cobalt, nickel, copper, zinc, titanium, cadmium, vanadium, tungsten, and magnesium. In one specific example, the magnetic particles are chosen from carbonyl iron particles, which can come in the form of a powder.

It is to be understood that the magnetic particles may have any shape, such as a rod-like shape, a spherical shape, a cubic shape, a flake shape, a bead shape, and/or a pellet shape. In an example, the magnetic particles may also take the form of a powder.

In an example, the size (e.g., diameter) of the magnetic particles ranges from about 1 μm to about 20 μm.

Disposing the non-magnetic particles in the carrier fluid may be accomplished, e.g., by adding the non-magnetic particles to the carrier fluid or by adding the carrier fluid to the non-magnetic particles. It is to be understood that the non-magnetic particles may, in some examples, be added to the carrier fluid, or vice versa, when the carrier fluid has the magnetic particles disposed therein. In instances where the non-magnetic particles are added to the carrier fluid, or vice versa, before the magnetic particles are added to the carrier fluid, the magnetic particles may be added to the carrier fluid, or vice versa, when the carrier fluid has the non-magnetic particles disposed therein.

As previously mentioned, the non-magnetic particles are particles of an SMA that exhibits superelastic properties. Shape memory alloys are a group of metallic materials that are able to return to a defined shape, size, etc. when exposed to a suitable stimulus. SMAs undergo phase transitions in which yield strength (i.e., stress at which a material exhibits a specified deviation from proportionality of stress and strain), stiffness, dimension and/or shape are altered as a function of temperature. In the low temperature or Martensite phase, the SMA is in a deformable phase, and in the high temperature or Austenite phase, the SMA returns to the remembered shape (i.e., prior to deformation). SMAs are also stress-induced SMAs (i.e., superelastic SMAs), again which will be described further hereinbelow.

When the shape memory alloy is in the Martensite phase and is heated, it begins to change into the Austenite phase. The Austenite start temperature ($A_s$) is the temperature at which this phenomenon starts, and the Austenite finish temperature ($A_f$) is the temperature at which this phenomenon is complete. When the shape memory alloy is in the Austenite phase and is cooled, it begins to change into the Martensite phase. The Martensite start temperature ($M_s$) is the temperature at which this phenomenon starts, and the Martensite finish temperature ($M_f$) is the temperature at which this phenomenon finishes.

FIG. 1 illustrates a stress and temperature based phase diagram for a shape memory alloy. The SMA horizontal line represents the temperature based phase transition between the Martensitic and Austenitic states at an arbitrarily selected level of stress. In other words, this line illustrates the temperature based shape memory effect previously described herein.

Superelasticity (SE) occurs when the SMA is mechanically deformed at a temperature that is above the $A_f$ of the SMA. In an example, the SMA is superelastic from the $A_f$ of the SMA to about $A_f$ plus 50° C. The SMA material formulation may thus be selected so that the range in which the SMA is superelastic spans a major portion of a temperature range of interest for an application in which the MR fluid will be used. In an example, the $A_f$ may range anywhere from cryogenic temperatures (e.g., about −150° C.) to about 200° C. In some instances, the $A_f$ may even exceed 200° C.

This type of deformation (i.e., mechanical deformation at a temperature that is above the $A_f$ of the SMA) causes a stress-induced phase transformation from the Austenite phase to the Martensite phase. Application of sufficient stress when an SMA is in its Austenite phase will cause the SMA to change to its lower modulus Martensite phase in which the SMA can exhibit up to 8% of "superelastic" deformation (i.e., recoverable strains on the order of up to 8% are attainable). The stress-induced Martensite phase is unstable at temperatures above the $A_f$, so that removal of the applied stress will cause the SMA to switch back to its Austenite phase. The application of an externally applied stress causes the Martensite phase to form at temperatures higher than the Martensite start temperature associated with a zero stress state (see FIG. 1). As such, the Martensite start temperature ($M_S$) is a function of the stress that is applied. Superelastic SMAs are able to be strained several times more than ordinary metal alloys without being plastically deformed. However, this characteristic is observed over the specific temperature range of $A_f$ to $A_f$ plus 50° C., and the largest ability to recover occurs within this range.

The temperature at which the shape memory alloy remembers its high temperature form may be altered, for example, by changing the composition of the alloy and through heat treatment. The composition of an SMA may be controlled to provide an $A_f$ that is below the operating temperature of the device (in which the MR fluid is used) so that the SMA will behave superelastically when sufficient stress is applied. In an example, the $A_f$ is selected to be within about 5° C. below the operating temperature of the device within which the MR fluid is being used.

As mentioned above, examples of the SMA that may be used in the examples disclosed herein are those that exhibit stress-induced superelasticity when at temperatures greater than the Austenite finish temperature ($A_f$) of the particular SMA. Some specific examples of the superelastic SMA that may be used for the examples of the MR fluid disclosed herein include nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-palladium based alloys, and the like. Some specific examples include alloys of copper-zinc-aluminum-nickel, copper-aluminum-nickel, nickel-titanium, zinc-copper-gold-iron, gold-cadmium, iron-platinum, titanium-niobium, gold-copper-zinc, iron-manganese, zirconium-cobalt, zinc-copper, and titanium-vanadium-palladium. Examples of nickel-titanium based alloys include alloys of nickel and titanium, alloys of nickel, titanium, and platinum, alloys of nickel, titanium, and palladium, or other alloys of nickel, titanium and at least one other metal.

Figure 2:
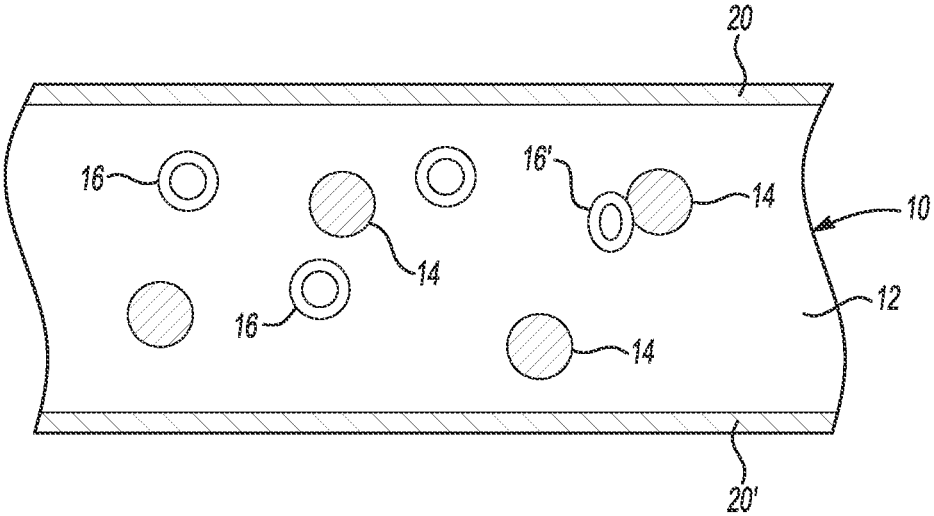
FIG. 2 schematically depicts an example of the MR fluid flowing between two opposed plates.

Further, the superelastic SMA may be used in the form of hollow particles, solid particles, or combinations thereof. As hollow particles, the superelastic SMA may take the form of hollow spheres having complete or incomplete shells. The SMA may also take the form of thin-walled structures that are either partially or fully filled with an elastic media. The elastic media may have a density and stiffness that are less than or equal to that of the SMA. The superelastic SMA may, in yet another example, take the form of hollow particles having other shapes (e.g., imperfect hollow spheres, hollow prisms, hollow pyramids, hollow cylinders, etc.). In some cases, the hollow particles have random shapes (e.g., some particles are spheres, some are cylinders, etc.). It is believed that hollow particles may impart less weight to the MR fluid, due to the lower net density of the individual SMA particles. The hollow portion of the particles may also provide some space for the shells of the respective particles to flex as the particles contact magnetic particles or other non-magnetic particles. An example of this is schematically shown in FIG. 2, which shows an MR fluid 10 enclosed between two plates 20, 20', where the MR fluid 10 contains a carrier fluid 12 and a plurality of magnetic particles 14 and non-magnetic particles 16. As a hollow sphere, one of the non-magnetic particles 16' is shown flexed as it contacts an adjacent magnetic particle 14.

For hollow superelastic SMA particles, it is desirable to have a relatively thin wall thickness. The wall thickness depends, at least in part, on the application in which the MR fluid will be used. In general, hollow particles having thick walls exhibit less deformability and less buoyancy than hollow particles having thin walls. Deformability is desirable so that the hollow superelastic SMA particles are able to be temporarily squeezed in more constricted areas and thus are less likely to clog these areas. Buoyancy is desirable so that the hollow superelastic SMA particles will float in the selected carrier fluid and will not settle if the system is inactive for a period of time. In an example, the wall thickness may be equal to or less than 5% of the radius of the spherical particle. In another example, the volume of the wall should be no more than 14% of the volume of the spherical particle. These examples may be desirable to achieve the desired buoyancy.

The wall thickness may also be determined by mathematical modeling. Modeling may involve estimating the maximum load that a spherical, superelastic SMA particle might experience in an application, and then using a model to estimate the wall thickness at which the yield strength of the material would be reached at a strain of 8%. This would provide a lower bound for the wall thickness, with the upper bound being less than the radius of the sphere.

While example wall thickness are provided herein, it is to be understood that the wall thickness may vary, for example, when the particles have an arbitrary shape.

As solid particles, the superelastic SMA may also take the form of a sphere (i.e., a solid sphere as opposed to a hollow sphere) or may take the form of another shape (e.g., solid imperfect spheres, solid prisms, solid cylinders, etc.). One example of solid particles for the superelastic SMA includes chopped wire segments. Further, the solid particles may have random shapes similar to those mentioned above for the hollow particles.

Whether the superelastic SMA particles are hollow or solid, it is to be understood that the size of the particles used in the MR fluid may be relatively consistent or may vary (i.e., a distribution of particle sizes may be included). The size of the particles used may depend, at least in part, on the application in which the MR fluid is being used. For example, when the MR fluid passes through small openings, a smaller particle size may be used and when the MR fluid passes through large tubes, a larger particle size may be used. The superelastic SMA particles disclosed herein (whether solid and/or hollow) may have a size ranging from about 10 μm to about 100 μm. In an example, the size (e.g., diameter) of the superelastic SMA particles ranges from about 10 μm to about 50 μm. In some instances, the superelastic SMA particles are not smaller than 20 μm, and in other instances, the superelastic SMA particles are selected to be similar in size to the magnetic particles that are used.

It is believed that the use of the superelastic SMA in the MR fluid achieves improved wear resistance, strength, cycle fatigue life, and fracture toughness when compared to MR fluids that contain other non-magnetic materials, such as aluminum, sand, ceramics, and glass. Examples of other non-magnetic materials were disclosed in U.S. patent application Ser. No. 12/576,485 filed Oct. 9, 2009. It was found, however, that the useful life of these other non-magnetic materials tended to diminish, and were thus useful for at most thousands of shear cycles. Based, at least in part, on its shape memory effect, it is believed that the useful life of the superelastic SMA particles disclosed herein may be lengthened, e.g., to millions of shear cycles.

It is also believed that the use of the superelastic SMA non-magnetic particles in the MR fluid imparts additional benefits to the system, e.g., based on the shape memory characteristics of the non-magnetic particles. These additional benefits include large recoverable strains and high deformability, which may contribute to one or more of the other benefits identified above. In particular, high deformability allows the superelastic SMA non-magnetic particles to alter their shape (e.g., squish) in, for example, restricted flow areas, so that the particles can readily flow through these areas without clogging the areas. The deformability also allows the superelastic SMA non-magnetic particles to regain their shape once passing through the restricted flow areas. The hollow superelastic SMA non-magnetic particles may also reduce the settling of the particles.

In an example, the magnetic particles 14 are present in the MR fluid 10 in an amount ranging from about 10 vol % to about 45 vol %, and the non-magnetic particles 16, 16' (i.e., the superelastic SMA particles) are present in the MR fluid 10 in an amount ranging from about 1 vol % to about 35 vol %. In other examples, the non-magnetic particles 16, 16' are present in an amount ranging from about 1 vol % to about 10 vol % or from about 8 vol % to about 35 vol %. In yet another example, a total amount of the magnetic particles 14 and the non-magnetic superelastic SMA particles 16, 16' in the MR fluid may range from about 11 vol % to about 55 vol %. In still another example, the magnetic particles 14 and the non-magnetic particles 16, 16', together, are present in the MR fluid 10 in an amount ranging from about 45 vol % to about 53 vol %. Further, the density of the MR fluid 10 containing the magnetic particles 14 and the non-magnetic particles 16, 16' may be reduced by about 0.5% to about 10% compared to MR fluids containing magnetic particles and non-magnetic particles, where the non-magnetic particles are selected from a non-magnetic material other than a superelastic SMA (such as those mentioned above, e.g., glass).

Superelastic SMAs exhibit large recoverable strains, high strength, high cycle fatigue life, and high fracture toughness. The superelastic SMAs are also highly deformable and wear resistant. Each of these characteristics renders the superelastic SMAs particularly suitable for MR fluids.

It is to be understood that the ranges provided herein include the stated range and any value or sub-range within the stated range. For example, a range from about 11 vol % to about 55 vol % should be interpreted to include not only the explicitly recited limits of about 11 vol % to about 55 vol %, but also to include individual values, such as 15 vol %, 23 vol %, 35 vol %, 45 vol % etc., and sub-ranges, such as from about 15 vol % to about 45 vol %, from about 20 vol % to about 40 vol %, etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

While several examples have been described, it will be apparent to those skilled in the art that the disclosed examples may be modified. Therefore, the foregoing description is to be considered non-limiting.

The invention claimed is:

1. A magnetorheological (MR) fluid, comprising:

a carrier fluid;

magnetic particles disposed in the carrier fluid; and non-magnetic particles disposed in the carrier fluid, the non-magnetic particles being particles of a shape memory alloy having an Austenite finish temperature ($A_f$) that is lower than a temperature encountered in an application in which the MR fluid is used so that the shape memory alloy exhibits stress-induced superelasticity.

2. The magnetorheological fluid as defined in claim 1 wherein the carrier fluid is chosen from water, mineral oils, synthetic oils, hydrocarbons, silicone oils, elastomers, fats, gels, greases, esters, polyethers, fluorinated polyethers, polyglycols, fluorinated hydrocarbons, halogenated hydrocarbons, fluorinated silicones, organically modified silicones, copolymers thereof, and combinations thereof.

3. The magnetorheological fluid as defined in claim 1 wherein the magnetic particles are chosen from a metal, a metal alloy, a magnetic oxide ceramic, a mixed ferrite, and combinations thereof.

4. The magnetorheological fluid as defined in claim 1 wherein the shape memory alloy is chosen from a copper-zinc-aluminum-nickel alloy, a copper-aluminum-nickel alloy, a nickel-titanium alloy, a zinc-copper-gold-iron alloy, a gold-cadmium alloy, an iron-platinum alloy, a titanium-niobium alloy, a gold-copper-zinc alloy, an iron-manganese alloy, a zirconium-cobalt alloy, a zinc-copper alloy, and a titanium-vanadium-palladium alloy.

5. The magnetorheological fluid as defined in claim 1 wherein the magnetic particles are present in an amount ranging from about 10 vol % to about 45 vol % of the magnetorheological fluid.

6. The magnetorheological fluid as defined in claim 1 wherein the non-magnetic particles are present in an amount ranging from about 1 vol % to about 35 vol % of the magnetorheological fluid.

7. The magnetorheological fluid as defined in claim 1 wherein the magnetic particles and the non-magnetic particles, together, are present in an amount ranging from about 45 vol % to about 53 vol % of the magnetorheological fluid.

8. The magnetorheological fluid as defined in claim 1 wherein the non-magnetic particles of the shape memory alloy are hollow particles.

9. The magnetorheological fluid as defined in claim 1 wherein the non-magnetic particles of the shape memory alloy are solid particles.

10. The magnetorheological fluid as defined in claim 1 wherein the non-magnetic particles of the shape memory alloy include a combination of hollow particles and solid particles.

11. The magnetorheological fluid as defined in claim 1 wherein the non-magnetic particles of the shape memory alloy are spherical, randomly shaped, or combinations thereof.

12. A method for making a magnetorheological (MR) fluid, the method comprising:

selecting a carrier fluid;

introducing magnetic particles into the carrier fluid; and introducing non-magnetic particles into the carrier fluid, the non-magnetic particles being particles of a shape memory alloy having an Austenite finish temperature ($A_f$) that is lower than a temperature encountered in an application in which the MR fluid is used so that the shape memory alloy exhibits stress-induced superelasticity.

13. The method as defined in claim 12, further comprising selecting the carrier fluid from water, mineral oils, synthetic oils, hydrocarbons, silicone oils, elastomers, fats, gels, greases, esters, polyethers, fluorinated polyethers, polyglycols, fluorinated hydrocarbons, halogenated hydrocarbons, fluorinated silicones, organically modified silicones, copolymers thereof, and combinations thereof.

14. The method as defined in claim 12, further comprising selecting the magnetic particles from a metal, a metal alloy, a magnetic oxide ceramic, a mixed ferrite, and combinations thereof.

15. The method as defined as in claim 12, further comprising selecting the shape memory alloy from a copper-zinc-aluminum-nickel alloy, a copper-aluminum-nickel alloy, a nickel-titanium alloy, a zinc-copper-gold-iron alloy, a gold-cadmium alloy, an iron-platinum alloy, a titanium-niobium alloy, a gold-copper-zinc alloy, an iron-manganese alloy, a zirconium-cobalt alloy, a zinc-copper alloy, and a titanium-vanadium-palladium alloy.

16. The method as defined in claim 12 wherein:

the introducing of the magnetic particles includes adding from about 10 vol % to about 45 vol % of the magnetic particles to the carrier fluid; and the introducing of the non-magnetic particles includes adding from about 1 vol % to about 35 vol % of the non-magnetic particles to the carrier fluid.

17. The method as defined in claim 12, further comprising selecting hollow particles, solid particles, or combinations of hollow and solid particles for the non-magnetic particles of the shape memory alloy.

* * * * *